United States Patent [19]

Brown, Jr.

[11] 4,138,349

[45] Feb. 6, 1979

[54] SILICONE LUBRICANT COMPOSITIONS CONTAINING TRISCHLOROETHYL-PHOSPHITE AND/OR BIS-CHLOROETHYL CHLOROETHYL PHOSPHONATE

[75] Inventor: Edgar D. Brown, Jr., Schenectady, N.Y.

[73] Assignee: General Electric Company, Waterford, N.Y.

[21] Appl. No.: 758,097

[22] Filed: Jan. 10, 1977

[51] Int. Cl.[2] ..... C10M 3/44; C10M 3/40; C10M 3/24

[52] U.S. Cl. ..... 252/49.9

[58] Field of Search ..... 252/49.9

[56] References Cited

U.S. PATENT DOCUMENTS

| | | | |
|---|---|---|---|
| 2,169,185 | 8/1939 | Shoemaker | 252/49.9 |
| 2,758,091 | 8/1956 | Webber | 252/49.9 |
| 2,837,482 | 6/1958 | Agens | 252/49.6 |
| 2,938,871 | 5/1960 | Matuszak et al. | 252/49.9 |
| 2,956,952 | 10/1960 | Fitzgerald et al. | 252/49.9 |
| 2,970,162 | 1/1961 | Brown, Jr. | 252/49.6 |
| 3,109,816 | 11/1963 | Feng et al. | 252/49.9 |
| 3,160,650 | 12/1964 | Birum et al. | 252/49.9 |
| 3,579,449 | 5/1971 | Wann et al. | 252/49.9 |
| 3,669,884 | 6/1972 | Wright | 252/36 |
| 3,937,684 | 2/1976 | Razzano | 260/46.5 G |

OTHER PUBLICATIONS

Davey, *Extreme Pressure Lubricants, Phosphorus Cpds as Additives,* "Ind. & Eng. Chem." 42, No. 9, pp. 1841–1847.

*Primary Examiner*—Delbert E. Gantz
*Assistant Examiner*—J. Thierstein
*Attorney, Agent, or Firm*—E. Philip Koltos; John L. Young; Frank L. Neuhauser

[57] ABSTRACT

The present invention relates to a silicone lubricant composed of an organopolysiloxane polymer and an effective amount of chlorinated phosphite or phosphonate. Such a lubricant composition is especially effective for lubricating soft metals such as copper or bronze and for improving dimethylpolysiloxane lubricants.

14 Claims, No Drawings

SILICONE LUBRICANT COMPOSITIONS CONTAINING TRISCHLOROETHYL-PHOSPHITE AND/OR BIS-CHLOROETHYL CHLOROETHYL PHOSPHONATE

BACKGROUND OF THE INVENTION

The present invention relates to a silicone lubricant composition and more specifically the present invention relates to a silicone lubricant composition for lubricating hard metal surfaces or soft metal surfaces such as copper or bronze.

Silicone lubricants are well known for hard metal surfaces. Such silicone lubricants usually comprise an organopolysiloxane polymer which may be dimethylpolysiloxane polymer, a methyl, higher-alkyl substituted polysiloxane polymer, or chlorophenyl or tetrachlorophenyl substituted polysiloxane polymer. Also, there are silicone lubricants in which the base lubricating fluid is composed of a trifluoropropyl substituting organopolysiloxane polymer. These fluids may be utilized by themselves or with various other additives for the lubrication of metal surfaces. For instance methyl, higher-alkyl substituted organopolysiloxane polymers are very effective for lubricating hard metal surfaces. In addition dimethylpolysiloxanes with various chlorinated additives are also known for lubricating hard metal surfaces such as for instance disclosed in Agens U.S. Pat. 2,837,482 which disclosure is incorporated in the present case by reference. Such chlorinated additives as described in the foregoing Agens Patent consist of octyltetrachlorobenzoate, dioctyltetrachlorophthalate and bis-2-ethylhexyl tetrachlorophthalate. In addition various types of chlorinated phthalates can be utilized as additives for dimethylpolysiloxanes such as bis-2-alkylhexyltetrachlorophthalates. In these compounds the alkyl may contain anywhere from 2 to 8 carbon atoms. As one example for instance the methyl, higher-alkyl substituted polysiloxanes have been shown to be effective as a lubricant for hard metals or any metal if they have a film thickness three times the surface roughness which for most hard metal surfaces would require film thickness of 30 to 45 micro inches. Most silicone lubricants and specifically methyl, higher-alkyl substituted polysiloxanes have a film thickness from 20 to 30 micro inches. Accordingly, what happens with hard metals is that the methyl higher-alkyl substituted polysiloxanes allow a slow attrition of the asperites in the metal surface and an improvement of the metal surface to a roughness of 5 micro inches which depth of surface roughness can be handled by the methyl higher-alkyl substituted polysiloxanes to lubricate such hard metal surfaces. For dimethylpolysiloxanes which are not as effective as the methyl higher-alkyl substituted polysiloxanes in lubricating metal surfaces, it is necessary to also add a chlorinated additive. Conventional chloride additives may also be added to methyl tetrachlorophenyl substituted polysiloxanes to form ferrous chloride hydrate compounds at the surface of the hard metal which is being lubricated so that the oxy chloride will shear off under stress and prevent undue wear against the hard metal surface. Accordingly in summary, it has been found out that methyl higher-alkyl substituted polysiloxane with or without additives will function in most cases as an effective lubricant for hard metals the dimethylpolysiloxane lubricants will function as lubricants for hard metals with the addition of chloride additives and that tetrachlorophenyl substituted polysiloxanes will function to some extent without additives in lubricating hard metal surfaces but will function most effectively with the use of chlorinated additives in the lubrication of hard metal surfaces. The reason the dimethylpolysiloxane polymers and the tetrachlorophenyl substituted polymers need the additives, is that they do not form as an effective thickness of film on the hard metal surfaces as is possible with the methyl higher-alkyl substituted polysiloxanes. However, all of these organopolysiloxane lubricants as well as others that haven't been mentioned above with or without the traditional chlorinated additives have a serious deficiency when it comes to lubricating soft metals, such as brass, bronze, soft steel, free machining steel, lead, copper, etc. In the case where the organopolysiloxane polymers are applied to lubricate soft metals, the wear rate is initially low and a low sliding friction prevails then after a short period of low wear a very high rate wear is experienced with a sizable increase in the sliding friction causing the metal parts to wear away at a higher rate.

It should also be pointed out that such chlorinated additives such as those of the Agens Patent are not as effective as would be desired even with silicone polymers in lubricating soft metals. When silicone lubricants are applied to lubricate soft metal, even in the case with methyl higher-alkyl substituted polysiloxanes that such prior chlorinated additives have to be utilized at very high concentrations of 4 to 10% by weight of the lubricating composition to effect any sizable change in the performance of the lubricant composition. Accordingly, it was highly desirable to be able to formulate an additive which could be utilized at small concentrations for addition to silicone polymers to prepare silicone lubricant compositions for the lubrication of soft metals. If was desired that such silicone lubricant with the additive in it would form oxychloride compounds on the soft metal surface and the soft metal being in contact with another soft metal or even a hard metal would allow the oxychloride compounds to shear off thus protecting the soft metal surface from wear. Prior art chloride additives needed to be utilized at high concentration as additives to silicone lubricants, since they were not very efficient in forming oxy chloride compounds at the point of wear.

Accordingly, it was thought it would be highly advantageous to obtain some type of chlorinated additive for such silicone lubricant which would form the appropriate type of oxychloride compounds which were needed for soft metal surfaces such as copper and bronze. Then the oxychloride compounds would be sheared off instead of the soft metal and allow the soft metal to wear gradually and not at a high rate as was experienced previously. Accordingly, it was highly desirable to formulate and obtain an additive for silicone polymers utilized in forming lubricant compositions which such additive would decrease the wear of hard metal surfaces but would more importantly decrease the wear of soft metal surfaces when they acted upon each other or when a soft metal surface acted against a hard metal surface. It should be noted that the foregoing discussion above as to the formation of oxychloride compounds at the surfaces of the metals and the function of such compounds preventing undue waer is a theoretical discussion.

In summary, what was needed was chlorinated additive or other type of additive for polysiloxane polymers that could be utilized as a lubricant to decrease the wear of metal surfaces acting against each other, which was much more efficient than the prior art organopolysiloxane polymers with various additives such as those for instance disclosed in the foregoing Agens U.S. Pat. No. 2,837,482.

Accordingly, it is one object of the present invention to provide for an additive for silicone lubricants which would decrease the wear of hard metal surfaces lubricated by such silicone polymers.

It is another object of the present invention to provide an additive for a silicone lubricating composition which would decrease the wear when such silicone lubricants was utilized to lubricate soft metal surfaces.

There is an additional object of the present invention to provide for an additive for a silicone lubricant composition which would decrease the wear when such lubricant composition was utilized to lubricate soft or hard metal surfaces acting against each other.

It is yet an additional object of the present invention to provide for a silicone lubricant composition which has excellent lubricity properties for lubricating copper, bronze, and brass surfaces. These and other objects of the instant invention are accomplished by the means of the disclosure set forth herein below.

SUMMARY OF THE INVENTION

In accordance with the above objects there is provided by the present invention a silicone lubricant composition comprising 100 parts by weight of an organopolysiloxane polymer having a viscosity varying from 50 to 50,000 centipoise wherein the organo groups are selected from the class consisting of monovalent hydrocarbon radicals and halogenated hydrocarbon radicals wherein there is added to the composition in an effective amount of a chlorinated phosphite or phosphonate and more specifically from 0.01 to 1 part by weight of a chlorinated phosphite or phosphonate. The most preferred phosphites and phosphonates for use in the instant composition is trischloroethylphosphite and bischloroethylchloroethyl phosphonate. Although, the instant additives may be utilized in traces amount as is desired for any type of silicone lubricant composition. It is most specifically suited for addition to lubricant compositions where the basic polymer is a dimethylpolysiloxane polymer or an organopolysiloxane polymer with the organo groups selected from methyl, tetrachlorophenyl or trifluoropropyl or from a methyl, high-alkyl substituted polysiloxane polymer. The additive may be utilized by itself or in combination with the well known chlorinated additives of the foregoing Agens Patent. For methyl, higher-alkyl, and tetrachlorophenyl substituted polysiloxanes the chlorinated additives of the foregoing Agens Patent are not needed. In the case of dimethylpolysiloxanes, the chlorinated additives of the foregoing Agens Patent should be added along with the phosphites and phosphonates of the instant case for optimum efficiency while the additives of the instant invention are disclosed primarily for the lubricating of soft metals that is where either of the two surfaces are soft metals it can also be utilized with advantage with hard metals, such as machine steel, tool steel, etc. The preferred soft metals in which the present lubricant composition can be used with respect thereto are for instance copper, brass, bronze, lead, tin and other soft metal surfaces, soft steel, machine steel, aluminum, etc. It should be noted while the instant case discloses only the use of two specific phosphites or phosphonates any highly chlorinated phosphites or with substitution which are soluble in the organopolysiloxane base polymer as described above may be utilized as additives in accordance with the instant invention. For some reason which is not known the phosphite or phosphonate radical activates the chlorinated part of the molecules, allowing it to form compounds at the surface of the soft metal, as it has been theoretically discussed above. However they perform their function, it has been found that the instant additives even in trace amounts do effectively decrease the wear for soft metal surfaces.

DESCRIPTION OF THE PREFERRED EMBODIMENT

Phosphite and phosphonate lubricant additives can be added to any silicone lubricant or any silicone polymer which is utilized as a lubricant to improve the lubricating properties of the silicone polymer. Preferably such polysiloxanes may be any organopolysiloxane where the organo to Si ratio may vary from 1.9 to 2.67 and where the organo groups are selected from monovalent hydrocarbon radicals and halogenated monovalent hydrocarbon radicals. Accordingly, while it is preferred that such silicone polymer be a linear polymer or essentially a linear diorganopolysiloxane polymer, nevertheless, they may be up to 10% in such linear diorganopolysiloxane polymer of monofunctional siloxy unit or trifunctional siloxy units. Most preferably, the organopolysiloxane polymer in one embodiment of the instant invention is a linear polysiloxane and more specifically a linear diorganopolysiloxane polymer where the organo to Si ratio varies from 1.9 to 2.01, where the organo groups are selected from monovalent hydrocarbon radicals and halogenated monovalent hydrocarbon radicals, and the polymer has a viscosity that varies anywhere from 50 to 50,000 centipoise at 25° C. Generally, the polymer may have a viscosity that may vary anywhere from 25 or 50 to 100,000 centipoise viscosity at 25° C., but more preferably the polymer has a viscosity that varies from 50 to 50,000 centipoise at 25° C. The above specificities with respect to the organopolysiloxane polymer apply to any of the preferred organopolysiloxane polymers that will be described below or that have been described above for utilization as the basic silicone lubricant polymer of the instant invention. Such organo substituent groups of such polymers may generally be selected from monovalent hydrocarbon radicals and halogenated monovalent hydrocarbon radicals such as, alkyl radicals, methyl, ethyl, propyl; higher alkyl radicals such as, decyl, dodecyl and etc.; mononuclear aryl radicals such as, phenyl, methylphenyl, ethylphenyl; cycloalkyl radicals such as, cyclohexyl, cycloheptyl, and etc.; halogenated monovalent hydrocarbon radicals such as, chlorophenyl, tetrachlorophenyl and trifluoropropyl and various other radicals and substituent groups for utilization in the polymers of the instant case which are well known and established as organic substituent groups in silicone polymers. One preferred lubricant for utilization in the instant case is where the organo substituent groups in the diorganopolysiloxane polymer are methyl such as a dimethylpolysiloxane polymer of a viscosity anywhere from 25 centipoise to 100,000 centipoise or more preferably of a viscosity of 50 centipoise to 50,000 centipoise at 25° C. Although such a polymer may have some phenyl substitution, in the most preferable form it does not have any phenyl substitution. Of course, as mentioned, the above does not apply to chlorophenyl or tetrachlorophenyl substituent groups since in another preferred embodiment of the instant case, the linear diorganopolysiloxane polymer has a minor amount of chlorophenyl or tetrachloropehnyl substituent groups along with methyl substituent groups.

The dimethylpolysiloxane polymer is utilized as a lubricant in accordance with the instant invention to which the phosphite and phosphonate additives of the instant case are applied. It is also preferred to utilize 1 to 10 parts by weight of chlorinated benzoate or chlorinated phthalate as disclosed in the foregoing Agens U.S. Pat. No. 2,837,482, in addition to the phosphite and phosphonate additives of the instant case. Such concentrations of the chlorinated phthalate or chlorinated benzoate are added per 100 parts of the linear diorganopolysiloxane polymer. It has been found in accordance with the instant invention that the lubricating compositions of the instant case have the maximum lubricating properties when there is added to such linear diorganopolysiloxane polymers and specifically linear dimethylpolysiloxane polymers, the foregoing chlorinated benzoates and chlroinated phthalates in addition to the phosphite and phosphonate additives of the instant case. Generally, it is not desired to add more than 10 parts of the benzoate or phthalate since more than 10 parts is not soluble in the linear dimethylpolysiloxane polymer and less than 1 part does not add any appreciable antiwear properties to the lubricating composition in combination with the phosphite and phosphonate additives of the instant case. Generally such chlorinated additives such as that disclosed in the foregoing Agens patent, which is incorporated into the present case by reference, can be any highly chlorinated benzoate or highly chlorinated phthalate, and specifically tetrachlorinated benzoate or tetrachlorinated phthalates. Specific preferred additional additives of the foregoing Agens patent for utilization in the lubricating compositions of the instant case are, for instance, octyltetrachlorobenzoate, dioctyltetrachlorophthalate, bis-2-ehtylhexyltetrachlorophthalate and bis-2-butylhexyltetrachlorophthalate. Generally with respect to the phthalates, any bis-alkylhexyltetrachlorophthalate may be utilized as an additive in the instant case to provide for lubricating compositions with enhanced lubricating properties and antiwear properties for soft metals as well as for hard metals.

It should be noted that basically any of the linear organopolysiloxane polymers of the instant case may be utilized with the foregoing chlorinated phthalates and benzoates with improved antiwear properties for hard metals. However, such chlorinated benzoates and phthalates are effective for adding or imparting antiwear properties to silicone lubricants for soft metals only at high concentrations. However, these chlorinated benzoates and phthalates are disclosed in the instant case as additives to silicone lubricant compositions in combination with the phosphites and phosphonates of the instant case, especially in the case of linear dimethylpolysiloxane polymers.

In the case where the silicone lubricant polymer is a linear methylchlorophenyl or tetrachlorophenyl substituted polysiloxane polymer within the above viscosity ambients then the foregoing chlorinated benzoates and phthalates may or may not be utilized as additives. Most preferably they are utilized as additives in combination with the phosphites and phosphonates of the instant case to impart to them optimum antiwear properties for soft metals for the lubricating compositions of the instant case.

In the case of methyl, high-alkyl substituted linear polysiloxane polymers such chlorinated benzoates and phthalates are not needed as antiwear additives when the silicone lubricant composition composed of such methyl higher-alkyl polymer is utilized to lubricate either soft or hard metals. With the methyl higher-alkyl polysiloxane silicone lubricant compositions only the phosphite and phosphonates of the instant case are needed to impart or improve the lubricant composition such that it has optimum antiwear properties when it is utilized to lubricate soft or hard metals. In any case, as disclosed in the instant case, the chlorinated benzoate and the chlorinated phthalate additives of the foregoing Agens patent may be utilized with advantage with certain linear diorganopolysiloxane silicone lubricant compositions as may be desired. At any rate, such additives do not produce any harmful effects when they are added to silicone lubricant compositions and are certainly advantageously added to the linear dimethylpolysiloxane silicone lubricant compositions, so as to optimize the antiwear properties of such polymers. The linear diorganopolysiloxane polymers may be produced by any method that is well known in the art. For instance, in the case of polysiloxanes substituted by methyl and phenyl units, polysiloxanes substituted by chlorophenyl, tetrachlorophenyl and methyl units and polysiloxanes substituted by methyl and trifluoropropylsiloxane units, such polymers may be prepared by the equilibration of the appropriate cyclotetrasiloxanes with the appropriate amount of chain-stoppers such as, hexamethyldisiloxane, octamethyltrisiloxane and etc. in the presence of an acid catalyst such as, toluene sulfonic acid, acid activated clay such as, Filtrol manufactured and sold by the Filtrol Corporation of Los Angeles, Calif., and etc. The amount of chain-stopper in the equilibration mixture will determine the final molecular weight of the equilibrated polymer (usually the equilibration is stopped when 85% of the cyclic-polysiloxanes has been converted to a linear polymer). At that time the equilibration which is carried on at elevated temperatures of about 100° C. is simply terminated by lowering the temperature, and venting off the excess cyclic material. In the case of the linear diorganopolysiloxane polymer that is to be composed of methyl and trifluoropropyl units, either the appropriate cyclictrisiloxane or tetracyclicsiloxane may be utilized in the equilibration reaction as is well known in the art. In any case whether the cyclictrisiloxanes or cyclicsiloxanes are utilized in the instant case depends on the choice or skill of the worker in the art in his experience with a particular type of reaction. As an example of a process for producing such methyltrifluoropropyl cyclicsiloxanes and producing a polymer therefrom, reference is to the Patent John S. Razzano, U.S. Pat. No. 3,937,684 which is incorporated into the present case by reference.

The methods for producing such linear diorganopolysiloxane polymers with various substituent groups is well known in the art and as such will not be repeated here in detail. Another preferred linear diorganopolysiloxane polymer for utilization as a basic lubricant in the invention of the instant case for soft metals with the additives of the instant case is a linear polysiloxane polymer having methyl and tetrachlorophenyl substituent groups. Such polymer is, for instance, disclosed for use as a lubricant in U.S. Pat. No. 2,970,162 — Brown, whose disclosure is hereby incorporated into the present case by reference. Accordingly, it will not be necessary to go into the preparation of such materials or disclosure. Suffice to say that such linear diorganopolysiloxane polymer substituted by methyl and tetrachlorophenyl substituent groups are well known. It was the discovery of the instant case that the utilization of the chlorinated phosphites and phosphonates of the instant case would improve such lubricants when they were utilized to lubricate soft metals such that the antiwear properties of such silicone lubricants are superior to that of the prior art.

Finally, there can be utilized as a preferred lubricant fluid in the lubricating composition of the instant case, a methyl higher-alkyl linear polysiloxane of a viscosity as set forth previously. Preferably the higher-alkyl group in such linear polysiloxane polymer has from 6 to 20 carbon atoms and is more preferably decyl, dodecyl and etc. Such polysiloxane polymer is linear except that each silicone atom has a substituent selected from methyl and also has a substituent selected from a higher-alkyl radical where the carbon atoms are the high-alkyl substituent groups in the linear polysiloxane polymer varies from 25 to 50 mole percent of the total substituent groups on the polymer. Such higher-alkyl polysiloxane polymers are generally produced by reacting a hydrogen-containing linear polysiloxane polymer, which can be produced by the foregoing equilibration techniques set forth previously, with an olefinic 6 to 20 carbon atom organic molecules such that the olefinic organic molecule is added on to the hydrogen atom of the polysiloxane to yield the methyl higher-alkyl substituted linear polysiloxane which may be utilized as a preferred lubricant in the instant case.

With respect to the production of the hydrogen polysiloxane, as stated previously, such hydrogen polysiloxanes may be produced by equilibration techniques along the line that is utilized for the methyltrifluoropropyl substituted polysiloxanes or the dimethyl substituted polysiloxanes. It should also be noted that such cyclictetrasiloxanes and cyclictrisiloxanes as needed in the foregoing equilibration processes, are easily produced by the hydrolysis of the appropriate dichlorosilanes and specifically such silanes as dimethyldichlorosilane, and methyltrifluoropropyldichlorosilane. By hydrolyzing such chlorosilanes in water there is obtained a mixture of cyclic and low molecular weight linear polysiloxanes and the cyclic material is increased in concentration and stripped off in fairly pure quantities by simply cracking the hydrolyzate with an alkali metal hydroxide at elevated temperatures.

With respect to the fluid methyl higher-alkyl polysiloxanes, one such preferred methyl, higher-alkyl polysiloxane that can be employed in the practice of the present invention can be characterized as having the average unit formula, $$(CH_3)_n(R)_m(R'(CH_2)_3)_p(R'')_qSiO_{(4-n-m-p-q)/2}$$

The sum (m+n+p+q) has a value of from 2.002 to 3.0; n has a value of from 0.50 to 1.95; m has a value of from 0.50 to 1.00; p has a value of from 0 to 0.5; q has a value of from 0 to one-fourth (m+n+p); R is an alkyl radical containing from six to 20 carbon atoms, e.g.; hexyl, octyl, decyl, dodecyl, tetradecyl, octadecyl radicals; R′ is a t-butyl-substituted hydroxyaryl radical and has the formula:

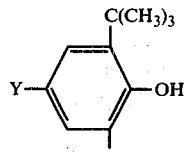

where Y is a member selected from the class consisting of hydrogen, monovalent hydrocarbon radicals, hydroxyaryl radicals, hydroxyaryl-substituted monovalent hydrocarbon radicals, hydroxyaryl ethers joined to the t-butyl-substituted hydroxyaryl radical through the ether linkage, hydroxyarylthioethers joined to the t-butyl-substituted hydroxyaryl radical through the thioether linkage and hydroxyaryl-methylene ethers joined to the t-butyl-substituted hydroxyaryl radical through the methylene ether linkage; R″ is selected from the class consisting of lower alkyl radicals having one to five carbon atoms, e.g., methyl, ethyl, propyl, butyl, pentyl, etc. radicals; cycloalkyl radicals having five to seven carbon atoms in the ring, e.g., cyclopentyl, cyclohexyl, cycloheptyl, etc. radicals; mono-nuclear and binuclear aryl radicals, e.g., phenyl, naphthyl, diphenyl, etc. radicals; mono-nuclear aryl lower alkyl radicals, e.g.; benzyl, tolyl, xylyl, phenylethyl, etc. radicals and halogenated derivatives of the above radicals.

Although any methylalkylpolysiloxane fluid within the scope of formula (1) is applicable in the process of the present invention, it is preferred that the fluid have a viscosity of from about 25 centistokes to about 100,000 centistokes when measured at 25° C.

The t-butyl-substituted hydroxyl aryl methyl higher-alkyl polysiloxane polymer described above is the preferred methyl higher-alkyl polysiloxane polymer for utilization as a silicone lubricant. Preferably, the t-butyl-substituted hydroxyaryl radical is present in the polymer chain so as to retard any oxidation of the lubricant fluid. Although a methyl higher-alkyl polysiloxane polymer may be utilized without such a t-butylsubstituted hydroxyaryl radical for anti-oxidation purposes in the preferred silicone lubricants of the instant case, it is desired to have such a substituent group in the higher-alkyl polysiloxane lubricant composition. The preparation of the methyl higher-alkyl polysiloxane polymers is more fully described in U.S. Pat. No. 3,669,884 which is incorporated into the present case by reference. Accordingly, it is not necessary to go into any detailed process about the preparation of such fluids since if any more details than that given above are needed as to the preparation of such methyl higher-alkyl polysiloxane polymers with or without the t-butyl substituted hydroxyaryl radical, reference should be made to the foregoing Wright '884 Patent which disclosure is hereby incorporated by reference. As stated previously, for such methyl, higher-alkyl polysiloxane polymers when such polymers are utilized to lubricate either hard metals or soft metals the foregoing chlorinated benzoate and phthalate additives of the Agens U.S. Pat. No. 2,837,482 are note needed, as long as the chlorinated phosphites, chlorinated phosphonate additives of the present case are present. It should be noted at this juncture that the foregoing chlorinated phosphites and chlorinated phosphonates of the instant case are not disclosed as substituent additives for the foregoing chlorinated benzoates and chlorinated phthalates of the foregoing Agens U.S. Pat. No. 2,837,482. The phosphites and phosponates of the instant case improve the antiwear and lubricating properties for soft metals of silicone lubricants considerably more efficiently and at a higher level than is the case when the chlorinated benzoates and chlorinated phthalates of the foregoing Agens U.S. Pat. No. 2,837,482 are utilized.

There are also other well known silicone polymers that may be utilized as silicone lubricants. Without mentioning these polymers in detail, it is sufficient to state that the instant chlorinated phosphites and chlorinated phosphonate additives of the instant case are impart superior antiwear properties for soft metals to such lubricants than has been the case when such polymers have been utilized without any additives or have been utilized with any of the prior art additives. Accordingly, with any of these silicone polymers that are utilized as lubricants, there may be utilized from 0.01 to 1 part by weight of a chlorinated phosphite or phosphonate. Although any chlorinated phosphite or phosphonate may be utilized, the most preferred that have been found suitable for most silicone lubricants and more specifically for the silicone lubricants mentioned above is tris-chloroethylphosphite and bis-chloroethylchloroethylphosphonate. There should be noted that it has been theorized that the tris-chloroethylphosphite changes to a bis-chloroethylchloroethyl phosphonate after the passage of time and the two compounds are in equilibrium with each other. It has been found that these two compounds are the most effective antiwear additives for the foregoing silicone lubricants with respect to soft metals, such as, copper, brass or bronze. Although less than 0.01 parts may be utilized, that is, even a slight trace of the instant phosphites and phosphonates will impart antiwear characteristics to a silicone lubricant, nevertheless it is felt that 0.01 parts by weight of the chlorinated phosphite or phosphonate are needed per 100 parts by weight of the linear organopolysiloxane polymer for the phosphite or phosphonate to impart to the silicone lubricant sizable antiwear properties for soft metals.

Further, even though more than one part by weight of the chlorinated phosphite or phosphonate could be utilized, generally such an excess amount may not be soluble in the silicone lubricant, thus negating its effectiveness as an antiwear additive. Preferably, 0.2 to 0.6 parts of the chlorinated phosphite or phosphonate is utilized per 100 parts of the essentially linear organopolysiloxane polymer. Chlorinated phosphites and phosphonates are sold by Mobil Oil Company, Monsanto Chemical Company and Berg Warren Corp., as well as many others.

These phosphites and phosphonates are generally produced by reacting ethylene chlorohydrin with $P\,cl_3$. The phosphonates are formed spontaneously by Arbuzov rearrangement.

The above preparation for the foregoing phosphites and phosphonates is only meant to be exemplary, such materials being manufactured and sold by the foregoing companies listed above. Accordingly, it is not necessary to go into any further details as to their preparation.

Again, as stated previously, although the foregoing chloroethyl phosphites and phosphonates are the most preferred in the instant application, any other chlorinated alkyl phosphites and phosphonates may be utilized as additives in the lubricants of the instant case. In the examples below various additives were added to different organopolysiloxanes intended as lubricants. These mixtures were then tested for their lubricity properties on a Shell four-ball tester which comprises a device for holding three rigidly clamped one-half inch metal balls in a metal cup. A fourth rotating ball of the same diameter is then pressed into contact with the three stationary balls by an adjustable floating arm and allowed to run for 1 hour. The contact points on the three stationary balls shows a circular scar as wear progresses. The average diameter of these scars in millimeters after a 1 hour run at some particular speed and load is taken as the measurement of wear. The temperature at which the test is conducted may also be varied from room temperature to elevated temperatures of the order of about 150° C. All balls are immersed in the lubricant fluid during the test. The type of metal employed in the balls can be changed as, for example, lubricating surfaces can be steel-on-steel or steel-on-brass or brass-on-steel. In the examples below, in all tests there was a 40 killogram load on spinning ball which was made of bronze and in which the lubricant was maintained at a temperature of 167° F. The center ball on which the load was applied was rotated for 1 hour in the test in each case at a rotation of 1200 rotations per minute. The other balls were constructed of 52/100 tool steel. The sliding friction was also measured during each test. The examples below are given for the purpose of illustrating the reduction to practice of the instant invention and are not given for any purpose in limiting the definition and scope of the instant specification and claims. All percentage and parts are by weight.

EXAMPLE 1

In all of the test results tabulated below, there was utilized as the basic lubricating fluid, a fluid identified as Fluid X in the table below, which Fluid X is a linear polysiloxane having a 50 centipoise viscosity at 25° C. and was a methyldecyl-substituted polysiloxane polymer having trimethylsiloxy terminal groups which has 1–3% coupled into it of t-hydroxyphenyl units. All the percentages in the table are by weight of the additives added. The test as previously stated was carried out in a Shell 4-ball tester which was run with a 40 killogram load on the rotating ball which was made of 52/100 steel and rotated at a rotation of 1200 rotation per minute for 1 hour while impinging on three balls constructed of bronze all of which balls were immersed in the Fluid X. The amount of the additives added is indicated in the table below in which the lubricant and additive mixture was maintained at a temperature of 167° F. for the 1 hour length of the test. Results of the tests are as follows:

TABLE I

| Lubricant | | Wear Scar | μSL |
|---|---|---|---|
| Fluid X | | 1.7 mm | Rose to 0.15 |
| Fluid X + | 4% dibutylhexyltetrachlorophthalate | 0.84 mm | 0.05 |
| Fluid X + | 0.5% tris-chloroethylphosphite | 0.82 mm | 0.05 |
| Fluid X + | 0.25% tris-chloroethylphosphite | 0.93 mm | 0.05 |
| Fluid X + | 1.0% tris-chloroethylphosphite | 0.84 mm | 0.05 |

In addition, other conventional additives were tried. These failed completely.

| | | | |
|---|---|---|---|
| Fluid X + | dialkyl zinc dithiophosphite | 2.6 | rose to 1.7 |

-continued

| | | | | |
|---|---|---|---|---|
| Fluid X | " | dibutyl tin sulfide | 2.4 | rose to 1.5 |

As noted from the results set forth in Table 1 above, the instant phosphite and phosphonate additives were much more effective as antiwear additives for soft metals than were other conventional additives which failed completely and were at 1/4th the concentration just as effective as the dialkyltetrachlorophthalates an antiwear additives for soft metals. It should be noted that the instant phosphites and phosphonates as the above results in Table 1 indicate, even in trace amounts that is at a concentration of 0.25 weight percent in the methyl higher-alkyl fluid markedly improved the antiwear properties of said methyl higher-alkyl fluid toward soft metals as indicated above. Accordingly, at the same concentrations the chlorinated phosphite and chlorinated phosphonate additives of the instant case are the most effective additives for organopolysiloxane polymers as far as optimizing the antiwear properties of silicone lubricant polymers than is the case with prior art phthalate and benzoate additives and other prior art additives for this purpose.

I claim:

1. A silicone lubricant composition consisting essentially of 100 parts by weight organopolysiloxane having a viscosity varying from 25 to 100,000 centipoise at 25° C. wherein the organo groups are selected from the class consisting of monovalent hydrocarbon radicals and halogenated hydrocarbon radicals with from 0.01 to 1 part by weight of a chlorinated compound selected from the class consisting of tris-chloroethylphosphite and bis-chloroethylchloroethyl phosphonate and mixtures thereof.

2. The composition of claim 1 wherein the organopolysiloxane is a dimethylpolysiloxane.

3. The composition of claim 1 wherein in the organo group of said polysiloxanes are selected from the class consisting of methyl, chlorophenyl, tetrachlorophenyl and trifluoropropyl and mixtures thereof.

4. The composition of claim 1 wherein the organopolysiloxane has the formula;

$$(CH_3)_n\,(R)_m\,(R'\,(CH_2)_3)_p\,R''_qSiO_{(4-n-m-q)/2)}$$

wherein in R is an alkyl radical containing from 6 to 20 carbon atoms, R' is a t-butyl-substituted hydroxyaryl radical that has the formula:

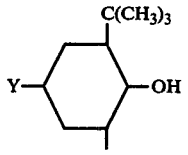

where Y is a member selected from the class consisting of hydrogen, alkyl radicals of 1 to 8 carbon atoms and hydroxyaryl radicals, where R'' is selected from alkyl radicals of 1 to 5 carbon atoms; n has a value of from 0.50 to 1.95; m has a value of from 0.50 to 1.0; p has a value of from 0 to 0.5; q has a value of from 0 to one-fourth (m + n + p) and the sum of m + n + p + q has a value of from 2.002 to 3.0.

5. The composition of claim 1 wherein the organopolysiloxane is a linear polysiloxane with an organo to Si weight ratio that may vary from 1.9 to 2.67.

6. A process for lubricating a metal surface selected from bronze, copper, tin, and lead consisting essentially of applying to the metal surface a silicone lubricant composition having 100 parts by weight of an organopolysiloxane wherein the organo groups are selected from the class consisting of monovalent hydrocarbon radicals and halogenated monovalent hydrocarbon radicals having a viscosity varying from 25 to 100,000 centipoise at 25° C. with from 0.01 to 1 part by weight of a chlorinated compound selected from the class consisting of tris-chloroethylphosphite and bis-chloroethylchloroethyl phosphonate and mixture thereof.

7. The process of claim 1 wherein the organopolysiloxane is dimethylpolysiloxane.

8. The process of claim 6 wherein the organo groups in said polysiloxane are selected from the class consisting of methyl, chlorophenyl, tetrachlorophenyl and trifluoropropyl and mixtures thereof.

9. The process of claim 6 wherein the organopolysiloxane has the formula:

$$(CH_3)_n\,(R)_m(R'(CH_2)_3)_pR''_qSiO_{(4-n-m-q)/2)}$$

wherein R is an alkyl radical containing from 6 to 20 carbon atoms, R' is a t-butyl-substituted hydroxyaryl radical that has the formula:

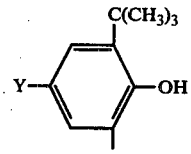

where Y is a member selected from the class consisting of hydrogen, alkyl radicals of 1 to 8 carbon atoms and hydroxyaryl radicals, R'' is selected from alkyl radicals of 1 to 5 carbon atoms; n has a value of from 0.50 to 1.95; m has a value of from 0.50 to 1.0; p has a value of from 0 to 0.5; q has a value of from 0 to one fourth (m+n+p) and the sum of m+n+p+q has a value of from 2.002 to 3.0.

10. The process of claim 6 wherein the organopolysiloxane is essentially a linear polysiloxane with an organo to Si weight ratio that may vary from 1.9 to 2.67.

11. A silicone lubricant composition consisting essentially of 100 parts by weight of an organopolysiloxane having a viscosity varying from 25 to 100,000 centipoise at 25° C. wherein the organo groups are selected from the class consisting of monovalent hydrocarbon radicals and halogenated monovalent hydrocarbon radicals with from 0.01 to 1 part by weight of a chlorinated compound selected from the class consisting of tris-chloroethylphosphite and bis-chloroethylchloroethylphosphonate and mixtures thereof with from 1 to 10 parts by weight of a compound selected from the class consisting of a chlorinated phthalate and a benzoate and mixtures thereof.

12. The composition of claim 11 wherein the chlorinated phthalate is selected from the class consisting of bis-2-ethylphenyl tetrachlorophthalate, bis-2-butylethylhexyl tetrachlorophthalate, octyltetrachlorobenzoate and dioctyltetrachlorophthalate.

13. A process for lubricating a metal surface selected from bronze, copper, tin and lead consisting essentially of applying to the metal surface a silicone lubricant composition having 100 parts by weight of an organopolysiloxane wherein the organo groups are selected from the class consisting of monovalent hydrocarbon radicals and halogenated monovalent hydrocarbon radicals having a viscosity varying from 25 to 100,000 centipoise at 25° C. with from 0.01 to 1 part by weight of a chlorinated compound selected from the class consisting of tris-chloroethylphosphite and bis-chloroethylchloroethylphosphonates and mixtures thereof with from 1 to 10 parts by weight of a compound selected from the class consisting of a chlorinated phthalate and benzoate and mixtures thereof.

14. The process of claim 13 wherein the chlorinated phthalate or benzoate is selected from the class consisting of bis-2-ethylhexyl tetrachlorophthalate, bis-2-butylethylhexyl tetrachlorophthalate, octyltetrachlorobenzoate and dioctyltetrachlorophthalate.

* * * * *